US006797886B1

(12) United States Patent
Gustafsson et al.

(10) Patent No.: US 6,797,886 B1
(45) Date of Patent: Sep. 28, 2004

(54) INSULATION COMPOSITION FOR AN ELECTRIC POWER CABLE

(75) Inventors: Bill Gustafsson, Stenungsund (SE); Annika Smedberg, Stenungsund (SE); Jari Aarila, Porvoo (FI); Arja Lehtinen, Helsinki (FI)

(73) Assignee: Borealis Technology Oy, Porvoo (FI)

( * ) Notice: Subject to any disclaimer, the term of this patent is extended or adjusted under 35 U.S.C. 154(b) by 83 days.

(21) Appl. No.: 10/018,644

(22) PCT Filed: Jun. 22, 2000

(86) PCT No.: PCT/SE00/01334

§ 371 (c)(1),
(2), (4) Date: Mar. 28, 2002

(87) PCT Pub. No.: WO01/03147

PCT Pub. Date: Jan. 11, 2001

(30) Foreign Application Priority Data

Jul. 1, 1999 (SE) ..... 9902510

(51) Int. Cl.[7] ..... H01B 7/00
(52) U.S. Cl. ..... 174/110 R; 174/120 R
(58) Field of Search ..... 174/110 R, 110 AR, 174/102 R, 102 SC, 105 R, 106 R, 106 SC, 120 R, 120 C, 120 SC; 523/173; 526/348, 348.2

(56) References Cited

U.S. PATENT DOCUMENTS 5,011,891 A * 4/1991 Spenadel et al. ..... 525/211
5,731,082 A * 3/1998 Gross et al. ..... 428/379
5,837,939 A * 11/1998 Cieloszyk et al. .... 174/110 PM
5,919,565 A * 7/1999 Gross ..... 428/379
6,203,907 B1 * 3/2001 Keogh ..... 428/379
6,369,129 B1 * 4/2002 Martensson et al. ..... 523/173

FOREIGN PATENT DOCUMENTS

EP 0735545 A * 10/1996 ..... H01B/7/28
EP 0952172 A * 10/1999 ..... C08G/81/02
EP 0974550 A * 10/1999 ..... C08L/23/04
EP 0966003 A * 12/1999 ..... H01B/3/44
SE WO 99/35652 A * 7/1999 ..... H01B/3/44

* cited by examiner

*Primary Examiner*—William H. Mayo, III
(74) *Attorney, Agent, or Firm*—Merchant & Gould P.C.

(57) ABSTRACT

An insulating composition for an electric power cable, and an electric power cable that includes a conductor surrounded by an inner semiconducting layer, an insulating layer, and an outer semiconducting layer, where the insulating layer consists of said insulating composition. The insulating composition is characterized in that the ethylene polymer is a multimodal ethylene copolymer obtained by coordination catalyzed polymerization of ethylene and at least one other alpha-olefin in at least one stage, said multimodal ethylene copolymer having a density of 0.890–0.940 g/cm$^3$, a $MFR_2$ of 0.1–10 g/10 min, a MWD of 3.5–8, a melting temperature of at most 125° C., and a comonomer distribution as measured by TREF, such that the fraction of copolymer eluted at a temperature higher than 90° C. does not exceed 10% by weight, and the multimodal ethylene copolymer includes an ethylene copolymer fraction selected from (a) a low molecular weight ethylene copolymer having a density of 0.900–0.950 g/cm$^3$ and a $MFR_2$ of 25–500 g/10 min, and (b) a high molecular weight ethylene copolymer having a density of 0.870–0.940 g/cm$^3$ and a $MFR_2$ of 0.01–3 g/10 min.

8 Claims, 2 Drawing Sheets

INSULATION COMPOSITION FOR AN ELECTRIC POWER CABLE

FIELD OF THE INVENTION

The present invention relates to an insulating composition for an electric power cable which comprises a crosslinkable ethylene polymer. The present invention also relates to an electric power cable comprising a conductor surrounded by an inner semiconducting layer, an insulating layer, and an outer semiconducting layer

BACKGROUND OF THE INVENTION

Electric power cables for medium voltages (6–69 kV) and high voltages (>69 kV) normally include one or more metal conductors surrounded by an insulating material like a polymer material, such as an ethylene polymer. In power cables the electric conductor is usually coated first with an inner semiconducting layer followed by an insulating layer, then an outer semiconducting layer followed by water barrier layers, if any, and on the outside a sheath layer. The layers of the cable are based on different types of ethylene polymers which usually are crosslinked.

A power cable of the above type is normally produced in the following way:

Three layers, one inner semiconductive layer, one insulating layer and one outer semiconducting layer, are extruded onto a conductor using a triple head extruder. In this construction the insulation layer is imbedded inbetween the semiconductive layers like a sandwich construction. The insulation layer itself is normally one single layer. The thickness of the different layers depend on the gradient and the rating that the cable is exposed to. Typical values for the thickness of a MV/HV (medium and high voltage) construction are the following: the semiconductive layers are about 0.5–2 mm each and the insulation layer about 3–30 mm.

The three layers are normally extruded onto the conductor at a low temperate below 135° C.) in order to prevent the crosslinking reactions from taking place during the extrusion process. After the extrusion step the construction is crosslinked in a pressurized vulcanizing tube at an elevated temperature.

LDPE (low density polyethylene), i.e. polyethylene prepared by radical polymerization at a high pressure and crosslinked by adding a peroxide in connection with the extrusion of the cable, is today the predominant cable insulating material. Radical polymerization results in long chain branched polymers having a relatively broad molecular weight distribution (MWD). This in turn results in desirable rheological properties with regard to their application as insulating materials for electric power cables.

A limitation with LDPE lies in the fact that it is made by radical polymerization. Radical polymerization of ethylene is carried out at high temperatures of up to about 300° C. and at high pressures of about 100–300 MPa. To generate the high pressures needed energy consuming compressors are required. Considerable investment costs are also required for the polymerization apparatus which must be able to resist the high pressures and temperatures of radical initiated high pressure polymerization.

With regard to insulating compositions for electric power cables it would be desirable both from a technical and an economical point of view if it were possible to make an ethylene polymer with the advantageous properties of LDPE, but which was not made by radical polymerization.

This would mean that insulation for electric cables could be made not only at plants for high pressure polymerization of ethylene, but also at the many existing plants for low pressure polymerization of ethylene. In order to be a satisfactory replacement for LDPE such a low pressure material would have to fulfill a number of requirements for insulating materials, such as good processability, high dielectric strength and good crosslinking properties. It has turned out, though, that for various reasons existing low pressure materials are not suitable as replacement for LDPE as insulating material for electric cables.

Thus, conventional high density polyethylene (HDPE) produced by polymerization with a coordination catalyst of Zieger-Natta type at low pressure has a melting point of about 130–135° C. When a HDPE is processed in an extruder the temperature should lie above the melting point of 130–135° C. to achieve good processing This temperature lies above the decomposition temperature of the peroxidos used for the crosslinking of insulating ethylene polymer compositions. Dieumyl peroxide e.g. which is the most frequently used crosslinking peroxide starts to decompose at a temperature of about 135° C. Therefore, when HDPE is processed above its melting temperature in an extruder the crosslinking peroxide decomposes and prematurely crosslinks the polymer composition, a phenomenon referred to as "scorching". If, on the other hand the temperature is kept below the decomposition temperature of the peroxide then the HDPE will not melt adequately and unsatisfactorily processing will result.

Further, ethylene copolymers made polymerization with a coordination catalyst at low pressure, like linear low density polyethylene (LLDPE) are unsuitable due to poor processability. The processability may be improved by polymerizing the LLDPE in two or more steps (bimodal or multimodal LLDPE), but such LLDPE includes high melting HDPE fractions or components, particularly when the polymerization is carried out with conventional Ziegler-Natta catalysts, which makes LLDPE unsuitable for the same reason as conventional HDPE.

In this connection WO 93/04486 discloses an electrically conductive device having an electrically conductive member comprising at least one electrically insulating member. The insulating member comprises an ethylene copolymer with a density of 0.86–0.96 g/cm$^3$, a melt index of 0.2–100 dg/min, a molecular weight distribution of 1.5–30, and a composition distribution breadth index (CDBI) greater than 45%. The copolymer of this reference is unimodal as opposed to multimodal.

WO 97/50093 discloses a tree resistant cable comprising an insulation layer further comprising a multimodal copolymer of ethylene, said copolymer having a broad comonomer distribution as measured by TREF, a low WTGR value and specified MFR and density values. More over, a low dissipation factor is disclosed. The document does not discuss the problem of premature decomposition of the crosslinking peroxide.

EP-A-743161 discloses a process for coextruding an insulation layer and a jacketing layer on a conductive medium. The insulation layer is a metallocene based polyethylene having a narrow molecular weight distribution and a narrow comonomer distribution. The document further reveals that the extrusion of the narrow molecular weight polymer at a low temperature is likely to lead to melt flow irregularities (so called melt fracture). This problem can be overcome by coextruding the insulation and the jacketing layer simultaneously on the conductor.

WO 98/41995 discloses a cable where the conductor is surrounded by an insulation layer comprising a mixture of a metallocene based PE having a narrow molecular weight distribution and a narrow comonomer distribution and a low density PE produced in a high pressure process. The addition of LDPE in metallocene PE is necessary to avoid the melt flow irregularities, which are the result of the narrow molecular weight distribution of the metallocene PE.

In view of the above it would be an advantage if it was possible to replace crosslinkable LDPE made by radical initiated polymerization as a material for the insulating layer of electric power cables by an ethylene polymer made by coordination catalyzed low pressure polymerization. Such a replacement polymer should have rheological properties, including processability similar to those of LDPE. Further, it should have a low enough melting temperature to be completely melted at 125° C. in order to avoid "scorch" due to premature decomposition of the crosslinking peroxide.

SUMMARY OF THE INVENTION

It has now been discovered that LDPE may be replaced as a crosslinkable material for the insulation layer of electric cables by a crosslinkable ethylene copolymer made by coordination catalyzed low pressure polymerization which ethylene copolymer is a multimodal ethylene copolymer with specified density and viscosity and with melting temperature of at most 125° C.

More particularly the present invention provides an insulating composition for an electric power cable which comprises a crosslinkable ethylene polymer, characterized in that the ethylene polymer is a multimodal ethylene copolymer obtained by coordination catalyzed polymerization of ethylene copolymer and at least one other alpha-olefin in at least one stage, said multimodal ethylene copolymer having a density of 0.890–0.940 g/cm$^3$, a $MFR_2$ of 0.1–10 g/10 min a MWD of 3.5–8, a melting temperature of at most 125° C. and a comonomer distribution as measured by TREF, such that the fraction of copolymer eluted at a temperature higher than 90° C. does not exceed 10% by weight, a said multimodal ethylene copolymer including an ethylene copolymer fraction selected from (a) a low molecular weight ethylene copolymer having a density of 0.900–0.950 g/cm$^3$ and a $MFR_2$ of 25–500 g/10 min, and (b) a high molecular weight ethylene copolymer having a density of 0.870–0.940 g/cm$^3$ and a $MFR_2$ of 0.01–3 g/10 min.

Preferably, the polymer has a viscosity of 2500–7500 Pa.s at 135° C. and a shear rate of 10 s$^{-1}$ 1000–2200 Pa.s at 135° C. and a shear rate of 100 s$^{-1}$ 250–400 Pa.s at 135° C. and a shear rate of 1000 s$^{-1}$.

A density in the lower part of the range, i.e. 0.890–0.910 g/cm$^3$ is aimed at when a very flexible cable is desired. Such cables are suitable for applictions in cars, mines and the building industry. These low densities are only possible to reach by using a single site catalyst such as a metallocene type catalyst, at least for the higher molecular weight fraction. When densities in the range 0.910–0.940 g/cm$^3$ are chosen, the resulting cables are stiffer, but have better mechanical strength values, and are therefore more suitable for non-flexible power supply cables.

The present invention also provides an electric power cable comprising a conductor surrounded by an inner semiconducting layer, an insulating layer, and an outer semiconducting layer, characterized in that the insulating layer comprises a crosslinked ethylene copolymer obtained by coordination catalyzed polymerization of ethylene and at least one other alpha-olefin in at least one stage, said multimodal ethylene copolymer having a density of 0.890–0.940 g/cm$^3$, a $MFR_2$ of 0.1–10 g/10 min, a MWD of 3.5–8, a melting temperature of at most 125° C. and a comonomer distribution as measured by TREF such that the fraction of copolymer eluted at a temperature higher than 90° C. does not exceed 10% by weight, and sad multimodal ethylene copolymer including an ethylene copolymer fraction selected from (a) a low molecular weight ethylene copolymer having a density of 0.900–0.950 g/cm$^3$ and a $MFR_2$ of 25–500 g/10 min, and (b) a high molecular weight ethylene copolymer having a density of 0.870–0.940 g/cm$^3$ and a $MFR_2$ of 0.01–3 g/10 min.

Preferably, the polymer has a viscosity of 2500–7500 Pa.s at 135° C. and a shear rate of 10 s$^{-1}$ 1000–2200 Pa.s. at 135° C. and a shear rate of 100 s$^{-1}$ and 250–400 Pa.s at 135° C. and a shear rate of 1000 s$^{-1}$.

These and other characteristics of the invention will appear from the appended claims and the following description.

DETAILED DESCRIPTION OF THE INVENTION

Figure 1:
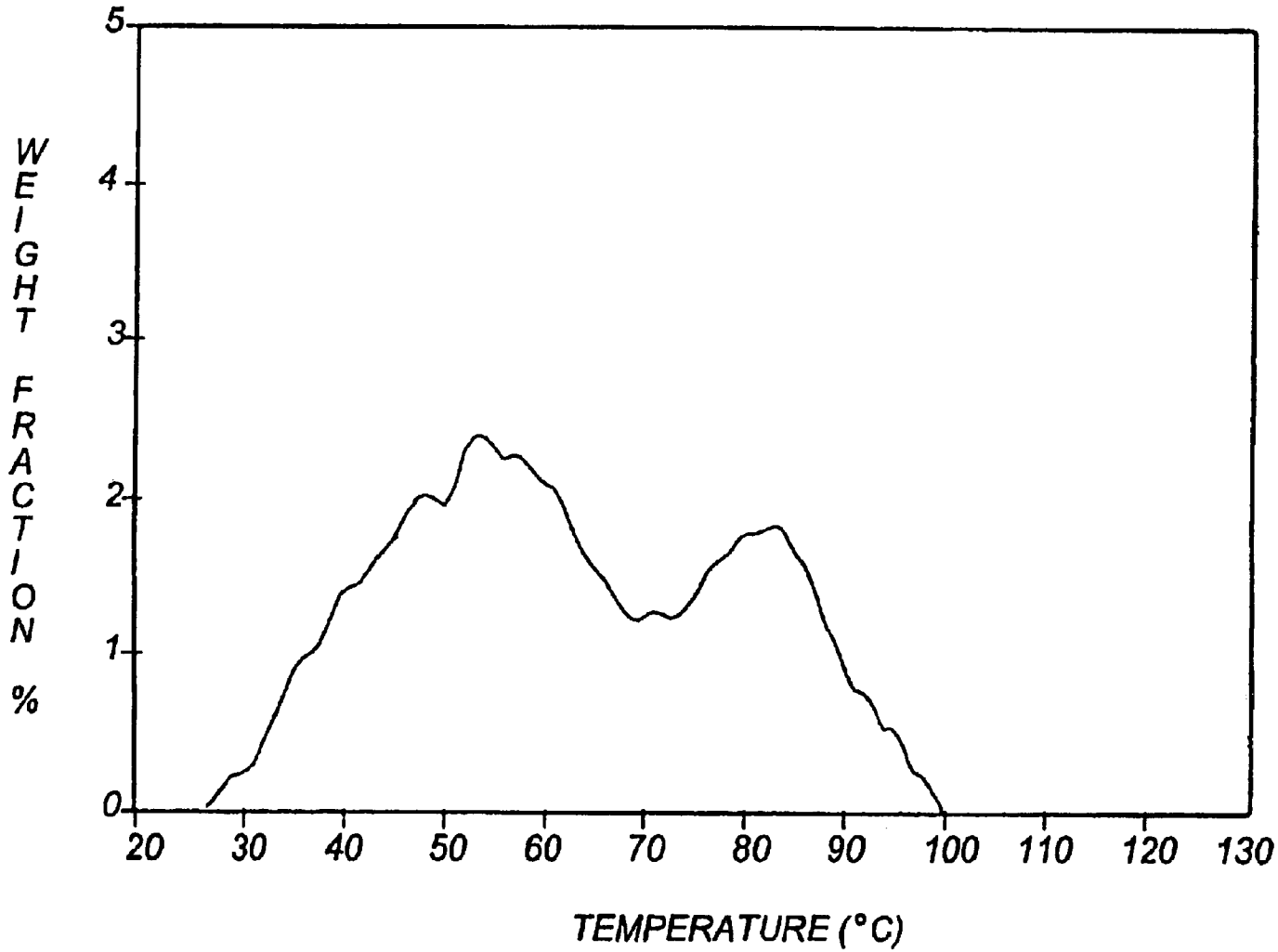
FIG. 1 illustrates the TREF fractogram of the copolymer for Example 3.

Before the invention is described in more detail, some key expressions will be defined.

By the "modality" of a polymer is meant the structure of the molecular-weight distribution of the polymer, i.e. the appearance of the curve indicating the number of molecules as a function of the molecular weight. If the curve exhibits one maximum, the polymer is referred to as "unimodal", whereas if the curve exhibits a very broad maximum or two or more maxima and the polymer consists of two or more fractions, the polymer is referred to as "bimodal", "multimodal" etc. In the following, all polymers which consist of at least two fractions and the molecular-weight-distribution curves of which are very broad or have more than one maximum are jointly referred to as "multimodal".

By the expression "melt flow rate" (MFR) used herein is meant, unless otherwise stated, the melt flow rate of a polymer as determined in accordance with ISO 1133, condition 4 ($MFR_2$). The melt flow rate, which is indicated in g/10 min, is an indication of the flowability, and hence the processability, of the polymer. The higher the melt flow rate, the lower the viscosity of the polymer.

The expression "coordination catalyst" encompasses catalysts of the Ziegler-Natta type and single site catalyst, such as metallocene catalysts.

The "molecular weight distribution" (MWD) of a polymer means its molecular weight distribution as determined by the ratio between the weight average molecular weight ($M_w$) and the number average molecular weight ($M_n$) of the polymer ($M_w/M_n$).

It is previously known to produce multimodal in particular bimodal, olefin polymers, preferably multimodal ethylene plastics, in two or more reactors connected in series. As instances of this prior art, mention may be made of EP 040 992, EP 041 796, EP 022 376 add WO 92/12182, which are hereby incorporated by way of reference as regards the production of multimodal polymers. According to these references, each and every one of the polymerization stages can be carried out in liquid phase, slurry or gas phase.

The catalyst used to produce the composition is a supported single site catalyst The catalyst should produce a relatively narrow molecular weight distribution and comonomer distribution in one stage polymerization. Also, the catalyst should be able to produce a high enough molecular weight so that good mechanical properties are obtained. It is known that some metallocene catalysts are able to produce a high enough molecular weight. Examples of such catalysts are e.g those based on siloxy-substituated bridged bis-indenyl zirconium dihalides, as disclosed in the Finnish patent application FI 960437 which have the general formula:

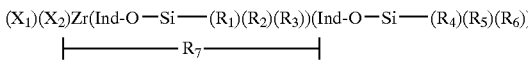

where $X_1$ and $X_2$ are either same or different and are selected from a group containing halogen, methyl, benzyl and hydrogen, Zr is zirconium, Ind is an indenyl group, $R_1$ to $R_6$ are either the same or different and are selected from a group containing linear and branched hydrocarbyl groups containing 1–10 carbon atoms and hydrogen, $R_7$ is a linear hydrocarbyl group containing 1–10 carbon atoms, Si is silicon, and O is oxygen;

or on n-butyl dicyclopentadienyl hafnium compounds disclosed in FI-A-934917 which have the general formula:

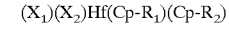

where $X_1$ and $X_2$ are either same or different and are selected from a group containing halogen, methyl, benzyl or hydrogen, Hf is hafnium, Cp i cyclopentadienyl group, and $R_1$ and $R_2$ are either the same or different and are either linear or branched hydrocarbyl groups containing 1–10 carbon atoms.

These catalysts may be supported on any known support material, such as silica, alumina, silica-alumina etc. Preferably, the catalyst is supported on silica. They are used together with an aluminumoxane cocatalyst. Examples of these cocatalysts are e.g. methylaluminumoxane (MAO), tetraisobutylaluminumoxane (TIBAO) and hexaisobutylaluminumoxane (HIBAO). The cocatalyst is supported on the carrier, preferably together with the catalyst complex.

When the aluminumoxane cocatalyst is supported on the carrier with the metallocene complex, a lower amount of the cocatalyst is needed than when it is introduced into the reactor separately. This is especially advantageous for a cable insulation material, since the low metal content results in a low dissipation factor. At the present invention the total metal contents (such as Al+Zr or Al+Hf) in the polymer preferably is less than 70 ppm, more preferably less than 50 ppm.

According to the present invention, the main polymerization stages are preferably carried out as a combination of slurry polymerization/gas-phase, polymerization or gas-phase polymerization/gas-phase polymerization. The slurry polymerization is preferably performed in a so-called loop reactor. The use of slurry polymerization in a stirred-tank reactor is not preferred in the present invention, since such a method is not sufficiently flexible for the production of the inventive composition and involves solubility problems. In order to produce the inventive composition, a flexible method is required. For this reason, it is preferred that the composition is produced in two main polymerization stages in a combination of loop reactor/gas-phase reactor or gas-phase reactor/gas-phase reactor. It is especially preferred that the composition is produced in two main polymerization stages, in which case the first stage is performed as slurry polymerization in a loop reactor and the second stage is performed as gas-phase polymerization in a gas-phase reactor. Optionally, the main polymerization stages may be preceded by a prepolymerization, in which case up to 20% by weight, preferably 1–10% by weight, of the total amount of polymers is produced. Generally, this technique results in a multimodal polymer through polymerization with the aid of a single site catalyst such as a metallocene catalyst in several successive polymerization reactors.

Alternatively, a multimodal polymer may be produced through polymerization in one singe polymerization reactor with the aid of a dual site coordination catalyst or a blend of different coordination catalysts. The dual site catalyst may comprise two or more different single site or metallocene species, each one of which produces a narrow molecular weight distribution and a narrow comonomer distribution. If a blend of catalysts is used, they need to be of a single site type of catalyst, such as metallocene catalysts. It is preferred, though, that the polymerization be carried out in two or more polymerization reactors connected in series.

In the production of a bimodal ethylene copolymer, a first ethylene copolymer fraction is produced in a first reactor under certain conditions with respect to monomer composition, hydrogen-gas pressure temperature, pressure, and so forth. After the polymerization in the first reactor, the reaction mixture including the copolymer fraction produced is fed to a second reactor, where further polymerization takes place under other conditions. Usually, a first copolymer fraction of high melt flow rate (low molecular weight) and with an addition of comonomer, is produced in the first reactor, whereas a second copolymer fraction of low melt flow rate (high molecular weight) and with an addition of comonomer is produced in the second reactor. As comonomer, use is preferably made of α-olefins having up to 8 carbon atoms, such as propene, 1-butene, 4-methyl-1-pentene, 1-hexene, and 1-octene. The resulting end product consists of an intimate mixture of the copolymers from the two reactor, the different molecular-weight-distribution curves of these copolymers together forming a molecular-weight-distribution curve having one broad maximum or two maxima, i.e. the end product is a bimodal polymer mixture. Since multimodal, and especially bimodal polymers, and the production thereof belong to the prior art, no further detailed description is called for here, but reference is made to the above specifications.

It should here be pointed out that, in the production of two or more polymer components in a corresponding number of reactors connected in series, it is only in the case of the component produced in the first reactor stage and in the case of the end product that the melt flow rate, the density and the other properties can be measured directly on the material removed. The corresponding properties of the polymer components produced in reactor stages following the first stage can only be indirectly determined on the basis of the corresponding values of the materials introduced into and discharged from the respective reactor stages.

Even though multimodal polymers and their production are known per se, it is not previously known to prepare multimodal copolymers having the specific characteristics defined above and use them as insulating layers for electric power cables.

As hinted above, it is preferred that the multimodal olefin copolymer in the cable-insulating composition according to the invention is a bimodal ethylene copolymer. It is also preferred that this bimodal ethylene copolymer has been produced by polymerization as above under different polymerization conditions in two or more polymerization reactors connected in series. Owing to the flexibility with respect to reaction conditions thus obtained, it is preferred that the polymerization is carried out in a loop reactor/a gas-phase reactor, a gas-phase reactor/a gas-phase reactor or a loop reactor/a loop reactor. The polymerization condition the preferred two-stage method are so chosen that a comparatively low molecular weight ethylene copolymer is produced in one stage, preferably the first stage, owing to a high content of chain-transfer agent hydrogen gas), whereas a high molecular weight ethylene copolymer is produced in another stage, preferably the second stage. The order of these stages may, however, be reversed.

As mentioned above, the multimodal ethylene copolymer of the invention should have a density of 0.890–0.940 g/cm$^3$.

Further, the comonomer content of the multimodal ethylene copolymer of the invention should lie within the range 2–22% by weight based on the copolymer. As the density of the copolymer is related to the comonomer content and is roughly inversely proportional to the comonomer content, this means that the lower density of 0.890 g/cm$^3$ corresponds to the higher comonomer content of about 18% by weight, whereas the higher density corresponds to the lower comonomer content of 2% by weight.

As stated earlier, the comonomer of the ethylene copolymer of the present invention is selected from other alpha-olefins, preferably other $C_3$–$C_8$ alpha-olefins. It is particularly preferred that the comonomer is selected from at least one member of the group consisting of propylene, 1-butene, 4-methyl-1-pentene, 1-hexene, and 1-octene.

The comonomer distribution of the polymer composition should be such that the composition does not contain high density polyethylene having a high melting temperature. This is the case if, when the composition is analyzed by TREF, the fraction of copolymer eluted at a temperature higher than 90° C. does not exceed 10%. Preferably, the fraction of copolymer eluted at a temperature higher than 90° C. does not exceed 7% and in particular, no more than 5% of the copolymer elutes at a temperature higher than 90° C.

Figure 2:
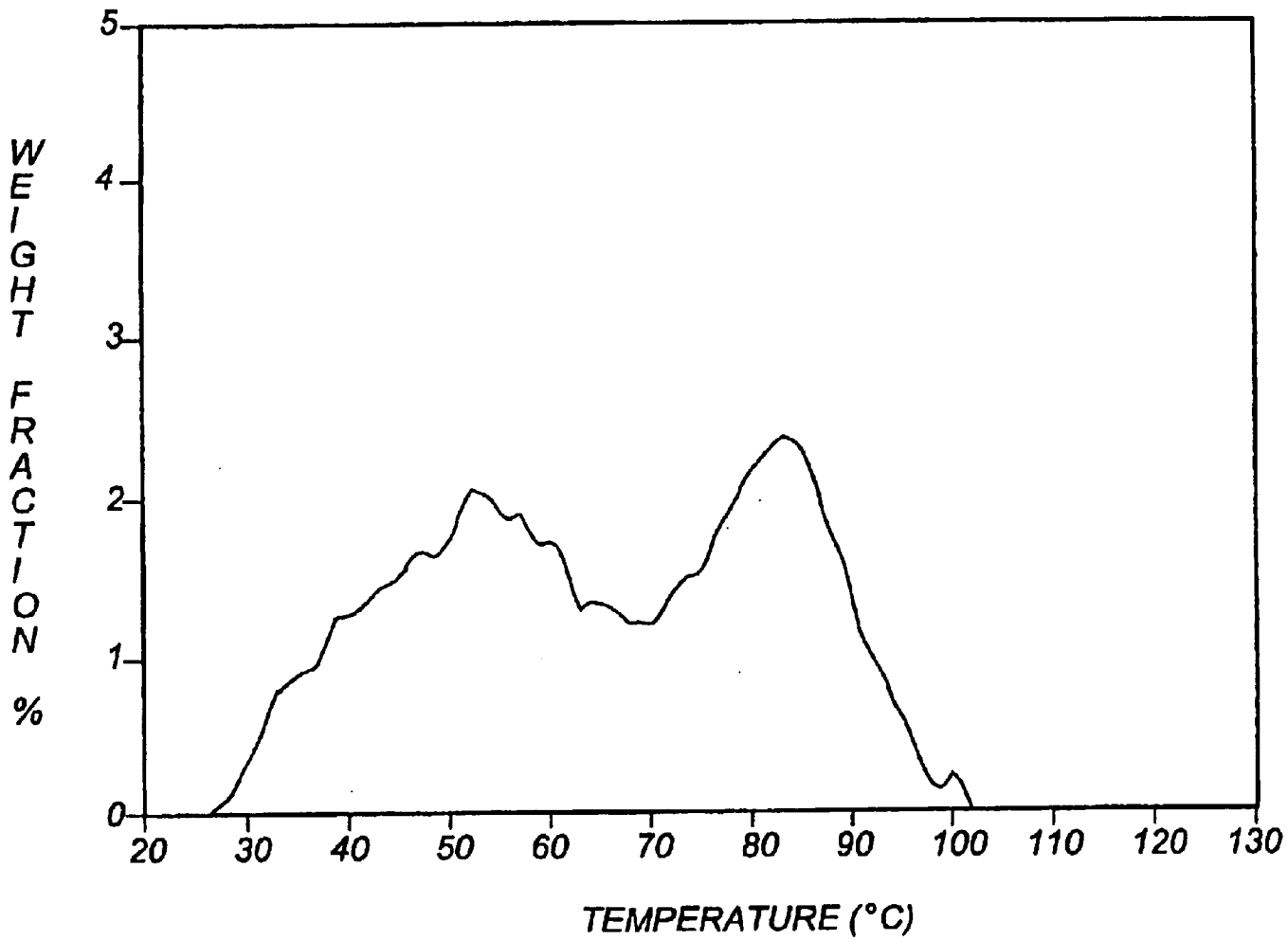
FIG. 2 illustrates the TREF fractogram of the copolymer for Example 4.

As is seen from the enclosed TREF fractograms of FIGS. 1 and 2 of Examples 3 and 4, respectively, the TREF fractogram of the copolymer according to the invention preferably contains two separate peaks.

It is an essential characteristic of the multimodal ethylene copolymer of the present invention that it has a melting temperature ($T_m$) of at most 125° C. This means that the multimodal ethylene copolymer does not contain any ethylene copolymer fraction with a melting temperature above 125° C.

Another essential characteristic of the multimodal ethylene copolymer of the present invention is that its processing properties are similar to those of LDPE. More particularly, the multimodal ethylene copolymer of the invention preferably has a viscosity of 2500–7500 Pa.s at 135° C. and a shear rate of 10 s$^{-1}$, 1000–2200 Pa.s at 135° C. and a shear rate of 100 s$^{-1}$, and 250–400 Pa.s at 135° C. and a shear rate of 1000 s$^{-1}$.

More preferably, the viscosity is as follows:

4000–7000 Pa.s at 135° C. and a shear rate of 10 s$^{-1}$,

1000–2000 Pa.s at 135° C. and a shear rate of 100 s$^{-1}$, and

300–350 Pa.s at 135° C. and a shear rate of 1000 s$^{-1}$.

The above viscosity values illustrate the processing behaviour of the multimodal ethylene copolymer of the invention very well. Further, the viscosity of the multimodal ethylene copolymer determined by its melt flow rate, $MFR_2$, should lie in the range 0.1–10.0, preferably 0.5–7.0 g/10 min, more preferably 0.5–3.0 g/10 min, and most preferably 1.0–3.0 g/10 min.

The multimodal ethylene copolymer of the invention has a molecular weight distribution, MWD, of 3.5–8, preferably 3.5–6, more preferably 4–6, and in particular 4–5.

In order to be crosslinkable the multimodal ethylene copolymer of the present invention should have a degree of unsaturation of at least about 0.3–0.6 double bonds/1000 carbon atoms.

The multimodal ethylene copolymer is made up of at least two ethylene copolymer fractions and the properties of the individual copolymer fractions should be so chosen that the above specified values of density/comonomer content, viscosity/melt flow rate, MWD and melting temperature of the multimodal ethylene copolymer are achieved.

Although the multimodal ethylene copolymer of the invention could in principle consist of a polymerized blend of any number of ethylene copolymer fractions, it is preferred that it consists of two ethylene copolymer fractions only, namely a low molecular weight (LMW) ethylene copolymer fraction and a high(er) molecular weight (HMW) ethylene copolymer fraction.

The preferred multimodal ethylene copolymer of the invention is thus obtained by a two-stage polymerization process, where a LMW ethylene copolymer fraction is produced in the first polymerization stage and a HMW ethylene copolymer fraction is produced in the second polymerization stage. Preferably for use in non-flexible power supply cable, the LMW ethylene copolymer fraction has a density of 0.925–0.940 g/cm$^3$, and a $MFR_2$ of 25–300, preferably 40–200, more preferably 50–100 g/10 min. For use in flexible applications the density should preferably lie in the range 0.900–0.925 g/cm$^3$. The comonomer content of the LMW ethylene copolymer fraction is preferably 3–15% by weight. The HMW ethylene copolymer fraction bas such a density, comonomer content, and MFR that the multimodal ethylene copolymer obtains the values of density/comonomer content, viscosity/melt flow rate, MWD and melting temperature specified above.

For use in flexible cable, it is preferred that the LMW fraction has a lower density of 0.900–0.925 g/cm$^3$ but similar $MFR_2$-values as for non-flexible cable applications.

More particularly, a calculation indicates that when the LMW ethylene copolymer has the above specified values, the HMW ethylene copolymer produced in the second polymerization stage of a two-stage process should have a density of 0.870–0.910 g/cm$^3$ for flexible cable and of 0.910–0.940 g/cm$^3$ for non-flexible cable, and a $MFR_2$ of 0.01–3, preferably 0.1–2.0 g/10 min. Preferably the comonomer content is 20–15% by weight in flexible compositions and 18–2% by weight in non-flexible ones.

As stated in the foregoing, the order of the polymerization stages may be reversed, which would mean that, if the multimodal ethylene copolymer has a density and a viscosity as defined above, and the HMW ethylene copolymer produced in the first polymerization stage has a density of 0.910–0.940 g/cm$^3$ for non-flexible applications and 0.870–0.910 g/cm$^3$ for flexible ones, and a $MFR_2$ of 0.01–3 g/10 min, then the LMW ethylene copolymer produced in the second polymerization stage of a two-stage process should, according to calculations as above, have a density of 0.920–0.950 g/cm$^3$ for non-flexible compositions and of 0.900–0.930 g/cm$^3$ for flexible ones, and a $MFR_2$ of 25–300 g/10 min. This order of the stages in the production of the multimodal ethylene copolymer according to the invention is, however, less preferred.

In the multimodal ethylene copolymer of the invention the LMW ethylene copolymer fraction preferably comprises 30–60% by weight of the multimodal ethylene copolymer and, correspondingly, the HMW ethylene copolymer fraction comprises 70–40% by weight.

Besides the multimodal ethylene copolymer and a cross-linking agent the insulating composition of the present invention may include various additives commonly employed in polyolefin compositions, such as antioxidants, processing aids, metal deactivators, pigments, dyes, colourants, oil extenders, stabilisers, and lubricants.

In order to further illustrate the present invention and facilitate its understanding some non-restricting Examples are given below.

In the Examples the following methods were used.

$MFR_2$ determined at 190° C. using 2.16 kg load, according to ISO 1133.

Density determined using ISO 1183.

TREF (Temperature Rising Elution Fractionation) described in L. Wild, T. R. Ryle, D. C. Knobeloch and I. R. Peak in Journal of Polymer Science: Polymer Physics Edition, Vol. 20, 441–455 (1982).

Ash content was determined by combusting the polymer and determining the amount of the residue.

Contents of Al, Zr and Hf were determined by AAS (Atomic Adsorption Spectroscopy).

Dissipation factor was measured according to IEC 250.

EXAMPLE 1

134 g of a metallocene complex (TA02823 by Witco, n-butyl dicyclopentadienyl hafnium dichloride containing 0.36% by weight Hf) and 9.67 kg of a 30% MAO solution supplied by Albemarle were combined and 3.18 kg dry purified toluene was added. The thus obtained complex solution was added on 17 kg silica carrier Sylopol 55 SJ by Grace. The complex was fed very slowly with uniform spraying during 2 hours. Temperature was kept below 30° C. The mixture was allowed to react for 3 hours after complex addition at 30° C.

The thus obtained catalyst was dried under nitrogen for 6 hours at 75° C. temperature. Then, the catalyst was further dried under vacuum for 10 hours.

EXAMPLE 2

168 g of a metallocene complex (ethylene bridged siloxy-substituted bis-indenyl zirconium dichloride according to the patent application FI 960437) and 9.67 kg of a 30% MAO solution supplied by Albemarle were combined and 3.18 kg dry purified toluene was added. The thus obtained complex solution was added on 9 kg silica carrier Sylopol 55 SJ by Grace. The complex was fed very slowly with uniform spraying during 2 hours. Temperature was kept below 30° C. The mixture was allowed to react for 2 hours after complex addition at 30° C.

The thus obtained catalyst was dried under nitrogen for 6 hours at 75° C. temperature. Then, the catalyst was further dried under vacuum for 10 hours.

EXAMPLE 3

Into a loop reactor having a volume of 500 dm$^3$ was introduced a polymerization catalyst prepared according to Example 1, propane diluent, ethylene, 1-butene comonomer and hydrogen. The reactor was operated at 85° C. temperature and 60 bar pressure. The feed rates of the components were such that 25 kg/h of polyethylene having $MFR_2$ of 85 g/10 min and density 934 kg/m$^3$ was formed. The polymer containing the active catalyst was separated from the reaction media and transferred to a gas phase reactor operated at 75° C. temperature and 20 bar pressure, where additional ethylene, hydrogen and 1-butene comonomer were added so, that in total 60 kg/h polyethylene having $MFR_2$ of 2.6 g/10 min and density 913 kg/m$^3$ was collected from the reactor. The fraction of the high MFR material (or low molecular weight material) in the total polymer was thus 42%.

The metal contents of the polymer were analyzed. The total ash content was 390 ppm, the Hf content was 1 ppm and the Al content was 35 ppm.

The viscosity of the polymer was measured at 10, 100 and 1000 s$^{-1}$ shear rates. They were found to be 5600, 2000 and 360 Pa.s respectively.

The polymer was analyzed by using TREF. The analysis revealed that 4.8% of the polymer eluted at at temperature higher than 90° C. and 1.2% eluted at a temperature higher than 95° C. (cf. FIG. 1).

Dissipation factor of the material was measured from 3.0 mm thick compression moulded plaques at 500 V. It was found to be $2.0 \cdot 10^{-4}$ and $0.9 \cdot 10^{-4}$ as measured immediately after compression moulding and after 3 days aging, respectively.

EXAMPLE 4

The polymerization was conducted as in Example 3, with the exception that a catalyst prepared according to Example 2 was used and that the temperature of the loop reactor was 75° C. In the loop reactor 25 kg/h of polyethylene having $MFR_2$ of 260 g/10 min and density 931 kg/m$^3$ was formed. The polymer containing the active catalyst was separated from the reaction media and transferred to a gas phase reactor operated at 75° C. temperature and 20 bar pressure, where additional ethylene, hydrogen and 1-butene comonomer were added so, that in total 52 kg/h polyethylene having $MFR_2$ of 1.4 g/10 min and density 918 kg/m$^3$ was collected from the reactor. The fraction of the high MFR material in the total polymer was thus 48%.

The metal contents of the polymer were analyzed. The total ash content was 190 ppm, the Zr content was less than 1 ppm and the Al content was 15 ppm.

The viscosity of the polymer was measured at 10, 100 and 1000 s$^{-1}$ shear rates. They were found to be 6200, 1700 and 330 Pa.s respectively.

The polymer was analyzed by using TREF. The analysis revealed that 4.5% of the polymer eluted at a temperature higher than 90° C. and 0.8% elated at a temperature higher than 95° C. (cf. FIG. 2).

Dissipation factor of the material was measured from 3.0 mm thick compression moulded plaques at 500 V. It was found to be $0.9 \cdot 10^{-4}$ and $0.4 \cdot 10^{-4}$ as measured immediately after compression moulding and after 3 days aging, respectively.

EXAMPLE 5

The polymerization was conducted as in Example 4. In the loop reactor 25 kg/h of polyethylene having $MFR_2$ of 150 g/10 min and density 929 kg/m$^3$ was formed. The polymer containing the active catalyst was separated from the reaction media and transferred to a gas phase reactor, where additional ethylene, hydrogen and 1-butene comonomer were added so, that in total 52 kg/h polyethylene having $MFR_2$ of 1.2 g/10 min and density 915 kg/m$^3$ was collected from the reactor. The fraction of the high MFR material in the total polymer was thus 48%.

The metal contents of the polymer were analyzed. The total ash content was 190 ppm, the Zr content was less than 1 ppm and the Al content was 13 ppm.

The viscosity of the polymer was measured at 10, 100 and 1000 $s^{-1}$ shear rates. They were found to be 6800, 1800 and 360 Pa.s respectively.

The polymer was analyzed by using TREF. The analysis revealed that 4.2% of the polymer eluted at a temperature higher than 90° C. and 0.7% eluted at a temperature higher than 95° C. Dissipation factor of the material was measured from 3.0 mm thick compression moulded plaques at 500 V. It was found to be $0.8 \cdot 10^{-4}$ and $0.5 \cdot 10^{-4}$ as measured immediately after compression moulding and after 3 days aging, respectively.

EXAMPLE 6

Into a sample of material produced in Example 3 was added 0.2-% by weight of 4.4'-thio-bis-(2-tert-butyl-5-methyl-phenol) stabiliser and 1.9 wt-% dicumylperoxide (used as a crosslinking agent). The composition was then compounded at a melt temperature of about 130° C. The cross-linking properties of the insulating composition were evaluated by the hot set test. In this test the elongation of dumbells was measured at 200° C. with a load of 0.2 MPa. The elongation was found to be 37% and the permanent deformation was found to be 1%.

EXAMPLE 7

The procedure of Example 6 was repeated, except that a material produced in Example 4 was used. It should be noted that the material of Example 4 contained 0.1% by weight of Irganox B561 stabilizer. In the hot set test the elongation was 25% and the permanent deformation 0.3%. Hot set data is summarized in Table 1:

TABLE 1

| | Elongation % | Permanent deformation % |
|---|---|---|
| Example 6 | 37 | 1 |
| Example 7 | 25 | 0.3 |
| Comparative Example 1 | 33 | 1 |

From the table it can be-concluded that the degree of crosslinking in Examples 6 and 7 with peroxide content of 1.9% was equal to that Comparative Example 1 with peroxide a content of 2.0%.

EXAMPLE 8

A model cable was produced using the composition according to Example 6 as an insulation layer. The model cable was produced by using of a triple extruder head where an inner semiconductive layer, insulation layer and an outer semiconductive layer were extruded in one step onto the conductor without difficulties. The semiconductive layers comprised a crosslinkable ethylene-butyl acrylate copolymer (17% by weight of BA) containing about 40% by weight of carbon black. The thickness: inner semicon layer was 0.7 mm, the thickness of the insultation layer was 1.5 mm and the thickness of the outer semicon layer was 0.15 mm.

The layers were coextruded through a triple head extruder onto a conductor using a temperature setting ranging from 105–130° C.

EXAMPLE 9

The procedure of Example 8 repeated, except that a composition produced in Example 7 was used. The data of Examples 8 and 9 and Comparative Example 1 is shown in Table 2. Also the values of dissipation factor are shown for Examples 8 and 9.

TABLE 2

| | $F_{min}$ Nm | $T_{10}$ min | Tan δ |
|---|---|---|---|
| Example 8 | 36 | 69 | $1.2.10^{-4}$ |
| Example 9 | 43 | 62 | $1.0.10^{-4}$ |
| Comparative Example 1 | 81 | 26 | |

The results show that the material according to the present invention has a better scorch resistance (higher value of T10) compared to a comparative material at an equal degree of crosslinking.

COMPARATIVE EXAMPLE 1

For the polymerization of ethylene a loop reactor and a gas-phase reactor connected in series were used together with a prepolymerization reactor (Pre PR). In addition to ethylene 1-butane was used as a comonomer in the loop reactor and the gas-phase reactor. Hydrogen was used as a modifier. The catalyst was a catalyst of Ziegler-Natta type and was added to the prepolymerization reactor. Propane was used as a reaction medium in the loop reactor. The gaseous components of the product from the loop reactor were removed in a flash tank, whereafter the product was transferred to the gas-phase reactor where the polymerization was continued. The polymerization conditions and the product properties are shown in Table 3.

The material was analyzed by using TREF. It revealed that 26.1% of the polymer eluted at-a temperature above 90° C. and 12.8% of the material eluted at a temperature above 95° C.

After compounding the copolymer with 0.2% by weight of Santonox R (a stabiliser), and adding 2.0% by weight of dicumyl peroxide (crosslinking agent) the crosslinking properties of the insulating composition were evaluated by the hot set test. In the hot set test, the elongation of dumbbells was measured at 200° C. with a load of 0.2 MPa. Decaline extraction was performed ASTM D 2765. The results are given in Table 4.

Table 4 also shows the results of scorch-testing. The measurements were performed on a Brabender Plasticorder PL 2000-6 at 5 rpm at 135° C. The oil heated kneader 350, 287 cm$^3$ with walzenkneaders W7646 was used. The time to increase the torque value by 10 Nm ($T_{10}$) from the minimum value ($F_{min}$) was measured.

It is evident from Table 4 that the insulating composition according to this example which has too high viscosity and too high TREF values is somewhat scorch sensitive. The $T_{10}$ time of 26 min should be compared with about 56 min for conventional crosslinkable LDPE. The hot set elongation was good.

TABLE 3

| | |
|---|---|
| First reactor (PR1) | |
| Temperature (° C.) | 85 |
| Pressure (MPa) | 6.1 |
| Ethylene concentration (MPa) | 0.66 |
| Hydrogen concentration (mol/kmol $C_2$) | 142 |
| 1-butene concentration (mol/kmol $C_2$) | 630 |
| Product density (g/cm$^3$) | 0.943 |
| $MFR_2$ (g/10 min) | 230 |
| Second reactor (PR2) | |
| Temperature (° C.) | 75 |
| Pressure (MPa) | 2.0 |
| Ethylene concentration (MPa) | 1.57 |
| Hydrogen concentration (mol/kmol $C_2$) | 30 |
| 1-butene concentration (mol/kmol/$C_2$) | 500 |
| Split (product ratio PrePR:PR1:PR2) | 1:42:57 |
| End product | |
| Product density (g/cm$^3$) | 0.926 |
| $MFR_2$ (g/10 min) | 0.53 |
| MWD | 11.3 |
| Melting temperature (° C.) | 122 |
| Comonomer content (% by weight) | 7.7 |
| Degree of unsaturation (C=C/1000 C.) | 0.27 |
| Apparent viscosity (Pa · s) at 135° C. | |
| Shear rate: 10 $s^{-1}$ | 7900 |
| Shear rate: 100 $s^{-1}$ | 1900 |
| Shear rate: 1000 $s^{-1}$ | 360 |

TABLE 4

| | |
|---|---|
| Elongation/Set (%/%) | 33/−1 |
| Gel content (%) | 79.6 |
| Scorch $T_{10}$ min | 26 |
| Scorch $F_{min}$ (nm) | 81 |

What is claimed is:

1. An electric power cable comprising a conductor surrounded by an inner semiconducting layer, an insulating layer, and an outer semiconducting layer, characterized in that the insulating layer comprises a crosslinked ethylene copolymer obtained by coordination catalyzed polymerization of ethylene and at least one other alpha-olefin in at least one stage, said multimodal ethylene copolymer having a density of 0.890–0.940 g/cm$^3$, a $MFR_2$ of 0.1–10 g/10 min, a MWD of 3.5–8, a melting temperature of at most 125° C., and a comonomer distribution as measured by TREF, such that the fraction of copolymer eluted at a temperature higher than 90° C. does not exceed 5% by weight, and said multimodal ethylene compolymer including an ethylene copolymer fraction selected from (a) a low molecular weight ethylene copolymer having a density of 0.900–0.950 g/cm$^3$ and a $MFR_2$ of 25–500 g/10 min, and (b) a high molecular weight ethylene copolymer having a density of 0.870–0.940 g/cm$^3$ and a $MFR_2$ of 0.01–3 g/10 min.

2. An insulating composition for an electric power cable which comprises a crosslinkable ethylene polymer, characterized in that the ethylene polymer is a multimodal ethylene copolymer obtained by coordination catalyzed polymerization of ethylene and at least one other alpha-olefin in at least one stage, said multimodal ethylene copolymer having a density of 0.890–0.940 g/cm$^3$, a $MFR_2$ of 0.1–10 g/10 min, a MWD of 3.5–8, a melting temperature of at most 125° C., and a comonomer distribution as measured by TREF, such that the fraction on of copolymer eluted at a temperature higher than 90° C. does not exceed 5% by weight, and said multimodal ethylene copolymer including an ethylene copolymer fraction selected from (a) a low molecular weight ethylene copolymer having a density of 0.900–0.950 g/cm$^3$ and a $MFR_2$ of 25–500 g/10 min, and (b) a high molecular weight ethylene copolymer having a density of 0.870–0.940 g/cm$^3$ and a $MFR_2$ of 0.01–3 g/10 min.

3. An insulating composition as claimed in claim 2, wherein the multimodal ethylene copolymer has a viscosity of 2500–7500 Pa.s at 135° C. and a shear rate of 10 $s^{-1}$, 1000–2200 Pa.s at 135° C. and a shear rate of 100 $s^{-1}$, and 250–400 Pa.s at 135° C. and a shear rate of 1000 $s^{-1}$.

4. An insulating composition as claimed in claim 3, wherein the multimodal ethylene copolymer has a viscosity of 4000–7000 Pa.s at 135° C. and a shear rate of 10 $s^{-1}$, 1000–2000 Pa.s at 135° C. and a shear rate of 100 $s^{-}$, and 300–350 Pa.s at 135° C. and a shear rate of 1000 $s^{-1}$.

5. An insulating composition as claimed in claim 2, wherein the comonomer of the copolymer is at least one member selected from the group consisting of propylene, 1-butene, 4-methyl-1-pentene, 1-hexene, and 1-octene.

6. An insulating composition as claimed in claim 2, wherein the MWD is 4–5.

7. An insulating composition as claimed in claim 2, wherein the multimodal ethylene copolymer is a bimodal ethylene copolymer comprising 30–60% by weight of a low molecular weight ethylene copolymer fraction and 70–40% by weight of a high molecular weight ethylene copolymer fraction.

8. An insulating composition as claimed in claim 2, wherein the multimodal ethylene copolymer includes a low molecular weight ethylene copolymer fraction having a density of 0.900–0.950 g/cm$^3$ and a $MFR_2$ of 50–100 g/10 min.

* * * * *